US007287518B2

(12) United States Patent
Tsuruta

(10) Patent No.: US 7,287,518 B2
(45) Date of Patent: Oct. 30, 2007

(54) VEHICLE FUEL SUPPLY CONSTRUCTION

(75) Inventor: Yuichiro Tsuruta, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 217 days.

(21) Appl. No.: 11/135,377

(22) Filed: May 24, 2005

(65) Prior Publication Data

US 2005/0263141 A1 Dec. 1, 2005

(30) Foreign Application Priority Data

May 25, 2004 (JP) ..... P.2004-154611

(51) Int. Cl.
*F02M 37/20* (2006.01)

(52) U.S. Cl. ..... 123/516; 123/509

(58) Field of Classification Search ..... 123/516, 123/514, 518, 519, 520
See application file for complete search history.

(56) References Cited

U.S. PATENT DOCUMENTS 4,757,872 A 7/1988 Inomata
5,103,793 A * 4/1992 Riese et al. ..... 123/516
5,456,235 A 10/1995 Porter
5,647,331 A * 7/1997 Swanson ..... 123/516
5,855,197 A * 1/1999 Kato ..... 123/516
6,257,208 B1 7/2001 Harvey
6,655,366 B2 * 12/2003 Sakai ..... 123/518
6,694,955 B1 * 2/2004 Griffiths et al. ..... 123/516
6,739,318 B2 * 5/2004 Nomura ..... 123/461

FOREIGN PATENT DOCUMENTS

CA 2 481 198 A1 1/1996
JP 55128653 A 10/1980
JP 2003120455 A 4/2003
JP 2003-129912 A 5/2003

* cited by examiner

*Primary Examiner*—Thomas Moulis
(74) *Attorney, Agent, or Firm*—Birch, Stewart, Kolasch & Birch, LLP

(57) ABSTRACT

A throttle body is connected to a rear portion of a cylinder head of an air-cooled engine, and a fuel pump is disposed in front of the engine. The fuel pump is such as to be disposed below a fuel tank 6 such a manner as to be separated therefrom and to be integrated with an auxiliary tank. Fuel is sent under pressure from the fuel pump to the throttle body via a fuel feed tube, and surplus fuel is returned to the integrated auxiliary tank, consequently, no piping for return fuel being required. Vapor generated in the fuel 23 returns to a space above a fuel level resulting when the fuel tank 6 is filled up via an exclusive return tube and is, therefore, prevented from mixing into fuel.

21 Claims, 8 Drawing Sheets

VEHICLE FUEL SUPPLY CONSTRUCTION

The present invention claims foreign priority to Japanese patent application no. p. 2004-154611, filed on May 25, 2004, the contents of which is incorporated herein by reference.

BACKGROUND OF THE INVENTION

1. Field of the Invention

The present invention relates to a vehicle fuel supply construction with a vapor return circuit.

2. Description of the Related Art

In vehicles having a fuel injection system, in order to prevent vapor of fuel generated by a fuel pump from mixing into fuel that is to be injected, a vapor return circuit is provided for separating the vapor from the fuel to return the vapor to a fuel tank.

As an example of such a vapor return circuit, there exists a vapor return circuit in which an injector into which a fuel pump and an injection nozzle are integrated is provided, fuel is supplied from a fuel tank to an auxiliary tank of the injector, and at the same time that fuel is injected by the fuel pump, fuel vapor is returned to the fuel tank as surplus fuel is returned to the fuel tank (refer to Japanese Patent Unexamined Publication JP-A-2003-129912).

In such a type as the aforesaid conventional example in which vapor is returned to the fuel tank together with surplus fuel, since a fuel return pipe is necessary, man hours are required to lay such a fuel return pipe. Moreover, when attempting to make an end portion of the fuel return pipe pass into the interior of the fuel tank from a bottom portion thereof, assembling and building become complicated. In addition, since vapor returns together with surplus fuel, this means that fuel into which vapor mixes is returned to the fuel tank.

SUMMARY OF THE INVENTION

Consequently, it is desired that only vapor is returned to above the fuel level in the fuel tank. An object of the invention is to realize what is desired.

With a view to solving the problem, according to a first aspect of the present invention, there is provided a vehicle fuel supply construction, comprising:

a fuel tank storing fuel;

a fuel pump supplying the fuel in the fuel tank to a fuel injection system for injection into an engine; and a vapor return unit for returning vapor of vaporized fuel generated in the fuel pump to the fuel tank, wherein the fuel pump is disposed separately from the fuel tank, is integrated with an auxiliary fuel tank, and is provided for its exclusive use with the vapor return unit for returning only vapor generated in an interior thereof to the fuel tank.

According to a second aspect as set forth in the first aspect of the present invention, it is preferable that an exhaust pipe is provided in such a manner as to be laid on one side of a vehicle body, while the fuel pump is disposed on the other side of the vehicle body.

According to a third aspect as set forth in the first aspect of the present invention, it is preferable that the fuel pump is disposed back of an engine cooling fan which is disposed in front of the engine.

According to a fourth aspect as set forth in the first aspect of the present invention, it is preferable that the fuel pump is disposed below the fuel tank.

According to a fifth aspect as set forth in the first aspect of the present invention, it is preferable that part of piping of the vapor return unit is laid along an external surface of the fuel tank so as to communicate and connect with the interior of the fuel tank at an upper position than a fuel level resulting when the fuel tank is filled up.

According to a sixth aspect as set forth in the first aspect of the present invention, it is preferable that the vapor return unit extends substantially vertical direction from an upper portion of the fuel pump to an upper portion of the fuel tank.

According to a seventh aspect as set forth in the first aspect of the present invention, it is preferable that the fuel pump includes a return joint protruding upwardly on an upper surface thereof, the return joint connecting an end of the vapor return unit.

According to an eighth aspect as set forth in the first aspect of the present invention, it is preferable that the vehicle fuel supply further comprising:

a L-shaped joint which connects the vapor return unit with the fuel tank on an upper portion of the fuel tank, the L-shaped joint having:

a flange portion on which the L-shaped joint is fixed to the fuel tank; and a protrusion portion protruded from the flange portion to the interior of the fuel tank.

According to a ninth aspect as set forth in the eighth aspect of the present invention, it is preferable that wherein a passage formed within the L-shaped joint is labyrinth construction.

According to a tenth aspect as set forth in the first aspect of the present invention, it is preferable that the vehicle fuel supply further comprising a joint including:

a cylinder portion; and a large-diameter portion on one end thereof, on which the joint fixes to the fuel tank, wherein a side wall of the fuel tank has a covering portion which covers circumference of the large-diameter portion of the joint.

According to the first aspect of the present invention, since the fuel pump that is disposed separately from the fuel tank is integrated with the auxiliary fuel tank, there is no need to return surplus fuel to the fuel tank by a fuel return tank, and therefore, such a fuel return pipe can be omitted. In addition, since only vapor is returned to the fuel tank by the exclusive vapor return unit, vapor can be returned to above the fuel level resulting when the fuel tank is topped up, thereby making it possible to prevent the mixture of vapor into fuel in the fuel tank.

According to the second embodiment, since the fuel pump is disposed on the opposite side of the vehicle body to the side thereof where the exhaust pipe is disposed, the fuel pump can be disposed away from the exhaust pipe, so that the thermal effect of the exhaust pipe is reduced to thereby suppress the generation of vapor.

According to the third aspect of the present invention, since the fuel pump is disposed back of the engine cooling fan, the fuel pump can be cooled by the engine cooling fan, so that the fuel pump is subjected to thermal effect of the engine with difficulty. Due to this, the generation of vapor can further be suppressed.

According to the fourth aspect of the present invention, since the fuel pump is disposed below the fuel tank, pipings for fuel supply and the vapor return unit can be made short and easy. Moreover, since vapor is allowed to rise smoothly from the fuel pump below towards the fuel tank disposed thereabove, the return of vapor can be ensured.

According to the fifth aspect of the present invention, since part of the piping of the vapor return unit is laid along the external surface of the fuel tank so as to communicate and connect with the interior of the fuel tank at the position above the fuel level resulting when the fuel tank is filled up, there is no need to pass the piping through the bottom surface of the fuel tank, facilitating the sealing of the connecting portion is facilitated, and the assembling and building can be facilitated.

DETAILED DESCRIPTION OF THE PREFERRED EMBODIMENTS

Figure 1:
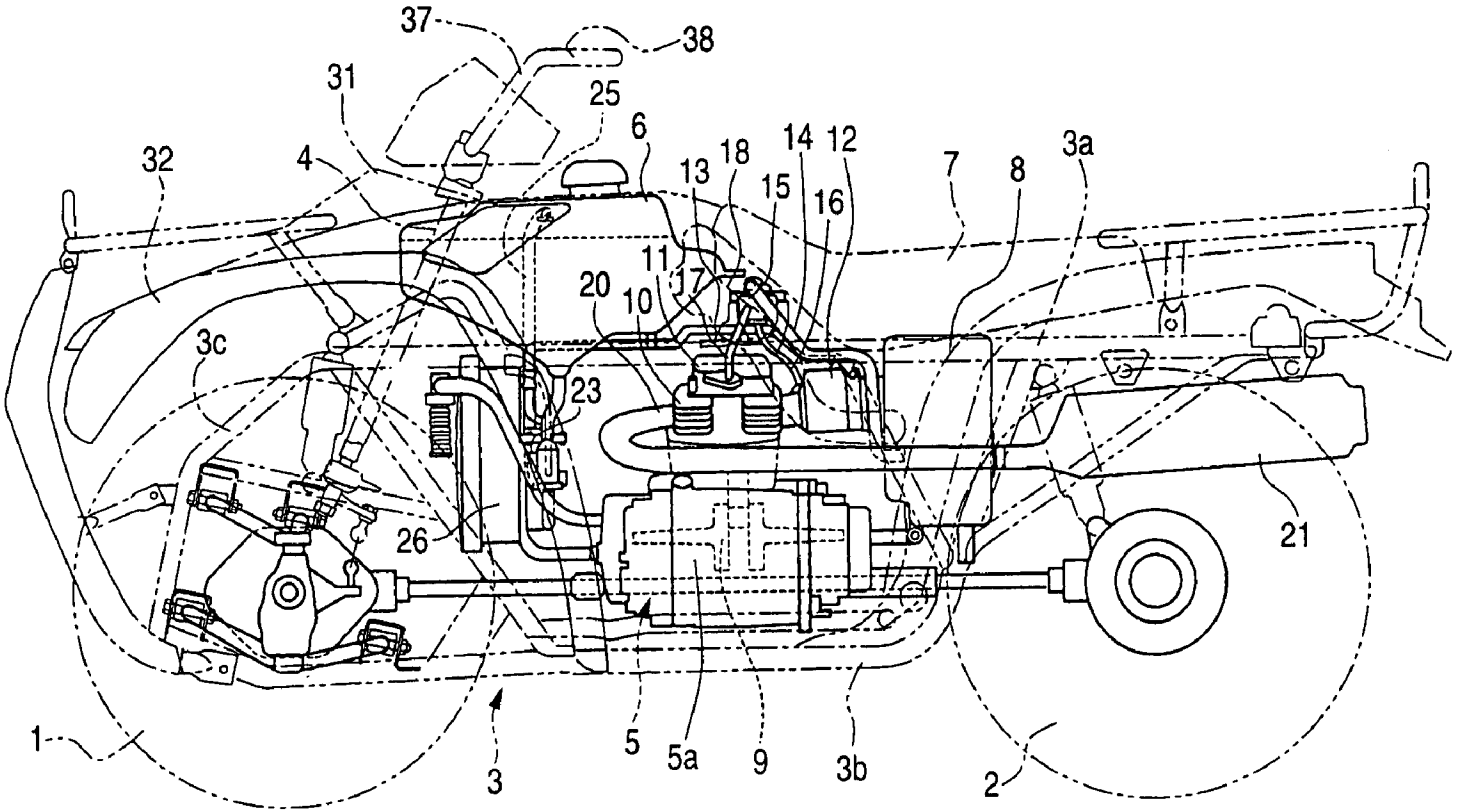
FIG. 1 is a side view of a 4-wheel buggy.

Hereinafter, an embodiment will be described by reference to the drawings in which the present invention is applied to a 4-wheel buggy, which is a saddle-riding type vehicle. FIG. 1 shows a side view of the 4-wheel buggy. Reference numeral 1 denotes a front wheel, and reference numeral 2 denotes a rear wheel, front wheels and rear wheels being each provided in pair on left and right sides of a vehicle body frame 3. The vehicle body frame 3 has upper frames 3*a* and lower frames 3*b*, which are arranged vertically, and the upper frames 3*a* and the lower frames 3*b* are each provided in pair in such a manner that the left and right frames extend in a longitudinal direction, the lower frames 3*b* being connected to the upper frames 3*a* at front and rear ends thereof. Reference numeral 4 denotes a steering shaft, 5 an engine, 6 a fuel tank, 7 a saddle type seat and 8 an air cleaner.

The engine 5 is a 4-cycle air-cooled engine and is disposed longitudinally with a crankshaft 9 being directed in the longitudinal direction. A cylinder head cover 11, which incorporates therein a valve train at an upper portion thereof, is provided on a cylinder head 10, and an induction passage is opened in a rear side of the cylinder head 10, a throttle body 12, which constitutes a fuel injection system, being connected to an opening in the induction passage. A cleaned air discharge portion of the air cleaner 8, which is disposed back of the throttle body 12, is connected to the throttle body 12. The air cleaner 8 is supported on the upper frames 3*a*. The fuel tank 6 and the seat 7 are also supported in the same manner.

The throttle body 12 has an ECU (Electronic Control Unit), which is integrated therewith, so as to perform ignition control and fuel injection control. Cleaned air is supplied from a clean side of the air cleaner 8 into the throttle body 12, and fuel is also supplied from a fuel feed tube 13 into the throttle body 12, so that an air-fuel mixture can be supplied into the induction passage to the cylinder head 10.

A secondary air supply system 15, which is connected to a front side of the air cleaner 8 via a secondary air suction hose 14, is disposed above the cylinder head 10. The secondary air supply system 15 is a secondary air valve device which is made compact by integrating a secondary air flow control valve and a reed valve, which is an opening and closing valve, with each other.

An exhaust port is provided in a front side of the cylinder head 10, and a front end of an exhaust pipe 20 is connected to the exhaust port so formed. The exhaust pipe 20 protrudes forward from the cylinder head 10, then bends in substantially a U-shape and extends rearwards by the cylinder head 10 to connect to a muffler 21.

As viewed sideways, the muffler 21 overlaps sideways an upper portion of the rear wheel 2 and is supported to a rear portion of the upper frame 3*a*. A catalyst is provided in the interior of the muffler 21 to purify exhaust fumes, and when secondary air is supplied to the exhaust port by the secondary air supply system, oxygen in the exhaust fumes is increased to thereby increase the purification efficiency by the catalyst.

An rear end portion of the exhaust pipe 20 passes across substantially a vertically center of a side of the air cleaner 8, and a connecting portion between the rear end portion of the exhaust pipe 20 and a front end portion of the muffler 21 is located in the vicinity of a rear end of the air cleaner 8. Reference numeral 5*a* denotes a crankcase, and an intermediate portion of the exhaust pipe 20 is disposed substantially in parallel with an upper surface of the crankcase 5*a*.

Figure 2:
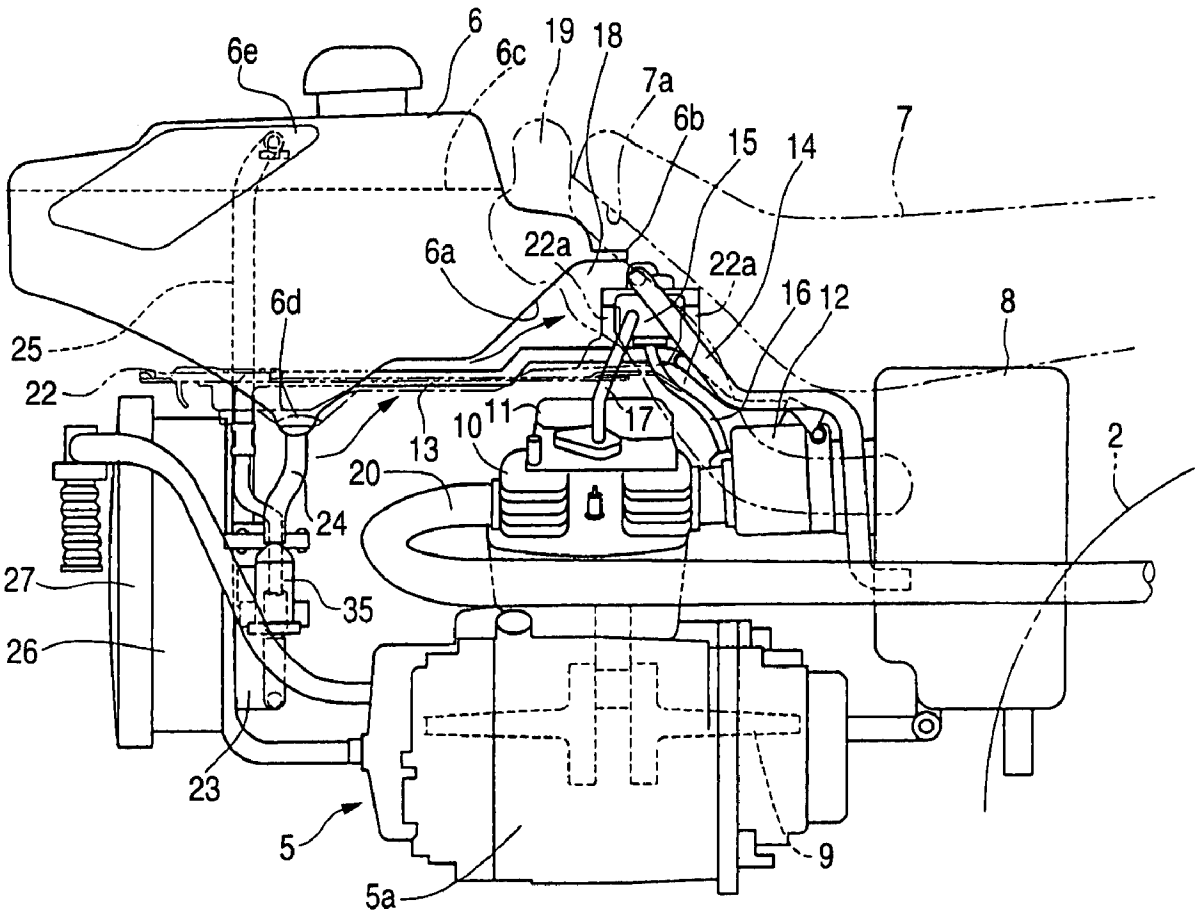
FIG. 2 is an enlarged side view of a main part of the same buggy.

As shown in FIG. 2, the secondary air supply system 15 operates through induction vacuum of the engine via a vacuum pipe 16 and delivers cleaned air supplied from the clean side of the air cleaner 8 from a secondary air delivery pipe 17 to the exhaust port of the cylinder head 10 as secondary air for purification of exhaust fumes.

The secondary air supply system 15 is connected to the induction passage of the cylinder head 10 via the vacuum pipe 16, whereby the flow control valve controls the volume of secondary air from the secondary air suction hose 14 according to the induction vacuum of an intake port, and a reed valve opens and closes at predetermined vacuum levels. When the reed valve opens, secondary air, the flow rate of which is so controlled, is supplied to the exhaust port via the secondary air delivery pipe 17.

The position of the secondary air supply system 15 is disposed within a space above cylinders of the engine or above-cylinder space 18 which is surrounded by a rear-side portion 6*a* of a bottom portion of the fuel tank 6, a front-side portion 7*a* of a bottom portion of the seat 7 and an upper portion of the cylinder head 10 and is supported by being superposed on bosses 22*a* which are formed at a rear end portion of a separate bottom plate 22 which extends rearwards from the bottom portion of the fuel tank 6 and being bolted thereto.

The rear-side portion 6*a* of the bottom portion of the fuel tank 6 inclines upwards to the rear and the front-side portion 7*a* of the bottom portion of the seat 7 inclines upwards to the front, whereby the above-cylinder space 18 is formed into substantially an angular shape as shown in the figure when viewed from the side. A rear end portion of the fuel tank 6 protrudes substantially horizontally at a position above the bottom plate 22 and constitutes an extending portion 6*b* which reaches the vicinity of the secondary air supply system 15.

A front portion of the secondary air suction hole 14 is disposed in such a manner as to incline downwards to the rear along the slope of the front-side portion 7*a* of the bottom portion of the seat 7, an intermediate portion of the secondary air suction pipe 14 is bent to become substantially horizontal above the throttle body 12 and a rear portion thereof extends vertically along a front side of the air cleaner 8, so that the secondary air suction hose 14 is made to communicate with the clean side of the air cleaner 8. Reference numeral 19 denotes a snorkel. A suction port at a front end of the snorkel 19 is positioned above a rear end of the fuel tank 6 and at a front end of the seat 7, and the snorkel 19 is disposed in such a manner as to incline to the rear along the front-side portion 7*a* of the bottom portion of the seat 7 so as to be connected to a dirty side of the air cleaner 8.

A fuel pump 23 is disposed separately from the fuel tank 6 in front of the engine 5 and below the fuel tank 6. The fuel pump 23 is connected via a fuel tube 24 to a lowermost portion 6*d* of the fuel tank 6 which is formed into substantially a funnel-like shape as viewed sideways and which protrudes downwards at the center of the bottom portion of the fuel tank 6, whereby fuel is supplied from the fuel tank 6 to the fuel pump 23 by virtue of free fall via a fuel filter 35 provided at an intermediate position along the length of the fuel tube 24. Fuel pressurized at the fuel pump 23 is supplied to the throttle body 12 via the fuel feed tube 13. The lowermost portion 6*d* is positioned substantially at the same height as that of the upper portion of the cylinder head 10 in such a manner as to overlap the cylinder head cover 11 in the longitudinal direction, and an upper portion of the fuel pump 23 is positioned substantially at the same height as that of the exhaust pipe 20. As a result, the fuel tube 24 is made to be a short tube that is disposed in a vertical direction.

The fuel feed tube 13 is laid out such that the fuel feed pipe 13 first extends upwards from the fuel pump 23, is then bent to the rear so as to become substantially horizontal so as to extend rearwards while overlapping part of the lowermost portion 6*d*, when viewed sideways, passes over the cylinder head 10 while taking substantially a U-shaped course, when viewed sideways, intersects with the vacuum pipe 16 and is connected to the throttle body 12 at a rear end thereof.

The fuel pump 23 is formed into substantially a cylindrical shape into which an auxiliary fuel tank is integrated and is disposed with its longitudinal direction oriented vertically. While the fuel tank 6 is made from a synthetic resin, which makes difficult the incorporation and integration of the fuel pump 23 thereinto, the fuel pump 23 can be disposed separately from the fuel tank 6 by adopting that configuration. A return tube 25, which is used exclusively to return vapor, extends upwards substantially perpendicularly from an upper portion of the fuel pump 23, and an upper end portion of the return tube 25 is attached to the interior of a recess 6*e* provided on the upper portion of the fuel tank 6 so as to communicate with a space above a fuel level 6*c* resulting when the fuel tank 6 is filled up.

Reference numeral 26 denotes a cooling fan for cooling the engine, and the fuel pump 23 is disposed on a back side of the cooling fan 26 when viewed sideways. The cooling fan 26 is made to forcibly cool with air an oil cooler 27 disposed in front thereof and the engine 5 situated back thereof. The oil cooler 27 is designed to allow engine oil within the crankcase 5*a* to circulate therein.

In addition, this cooling fan 26 is located at a position in front of and lower than the secondary air supply system 15, and while the fuel tank 6 exists between the cooling fan 26 and the secondary air supply system 15, part of cooling air that is sent from the cooling fan 26 to the rear of the vehicle body towards the engine 5 is guided by the rear-side portion 6*a* of the bottom portion of the fuel tank 6 which inclines upwards to the rear within the above-cylinder space 18 so as to flow to the vicinity of the secondary air supply system 15.

Figure 3:
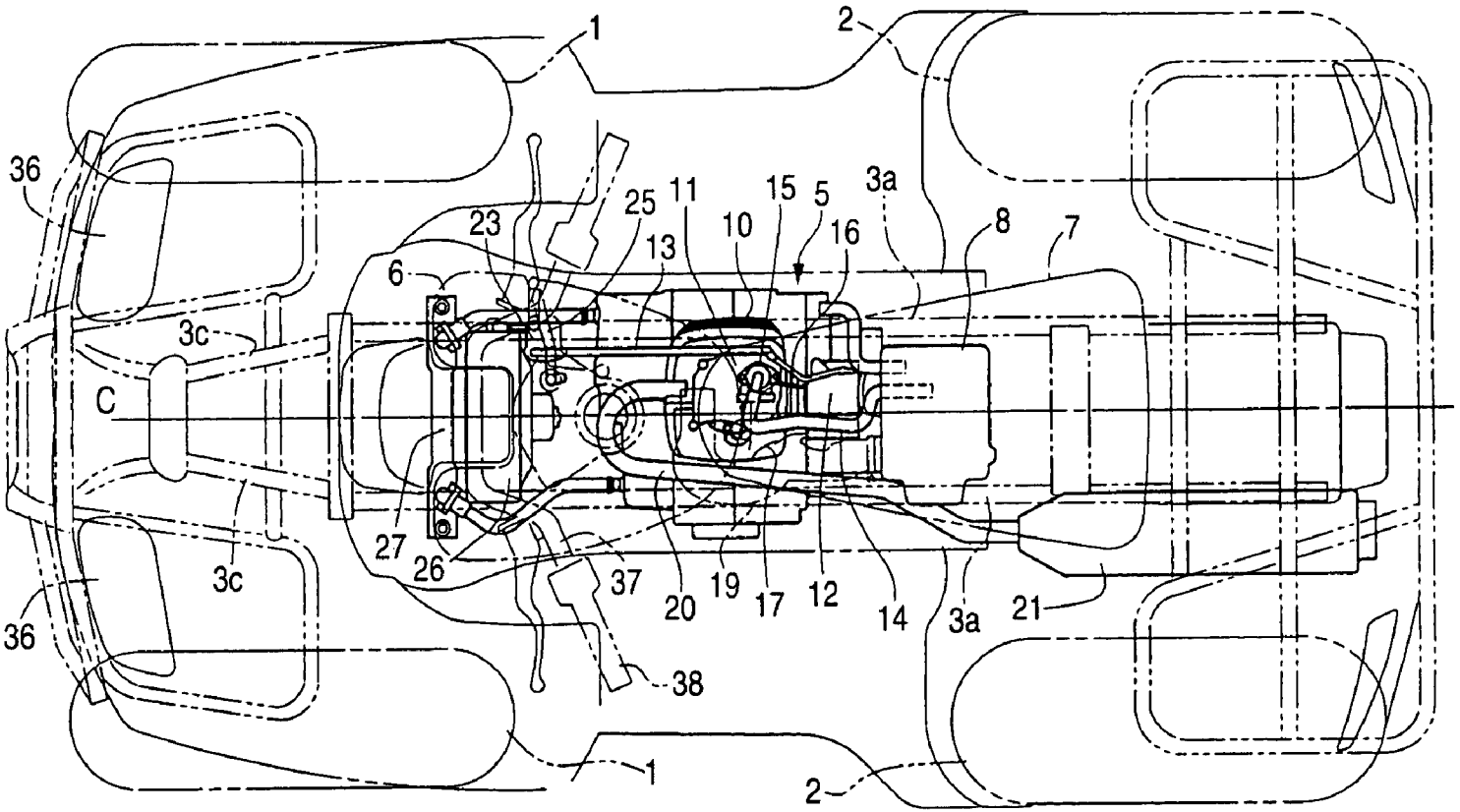
FIG. 3 is a plan view of the 4-wheel buggy.
Figure 4:
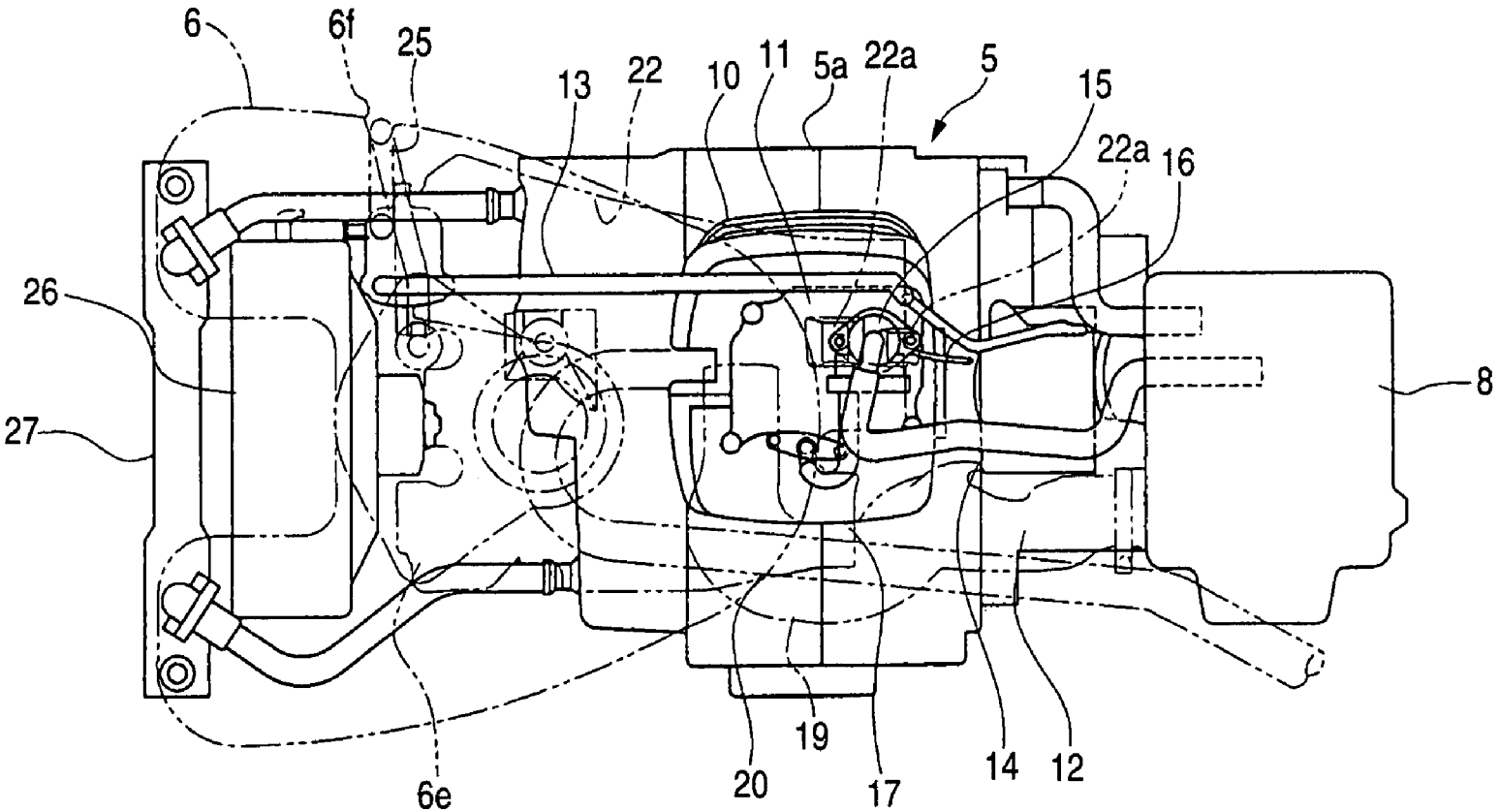
FIG. 4 is an enlarged plan view of the main part of the same buggy.

FIG. 3 is a plan view of the 4-wheel buggy, and FIG. 4 is an enlarged plan view of a main portion of the 4-wheel buggy. In these figures, the secondary air supply system 15 is located substantially in the vicinity of a center C of the vehicle body. The vacuum pipe 16 and the air cleaner 8 are also located substantially on the center of the vehicle body. The fuel pump 23 is disposed to be offset towards a right side of the vehicle body and is disposed, in other words, on an opposite side of the vehicle body to a side where the exhaust pipe 20 is laid out, the exhaust pipe 20 being laid out to a left side of the cylinder head 10, whereby the fuel pump 23 is disposed at the position away from the exhaust pipe 20 where the fuel pump 23 becomes difficult to be subjected to thermal effect from the exhaust pipe 20. The return tube 25 is laid out vertically in such a state that the return tube 25 is received in a recessed groove formed in a side of the fuel tank 6 (FIG. 4). In FIG. 3, reference numeral 36 denotes a headlight, reference numeral 37 a handle bar and reference numeral 38 a handle grip.

Figure 5:
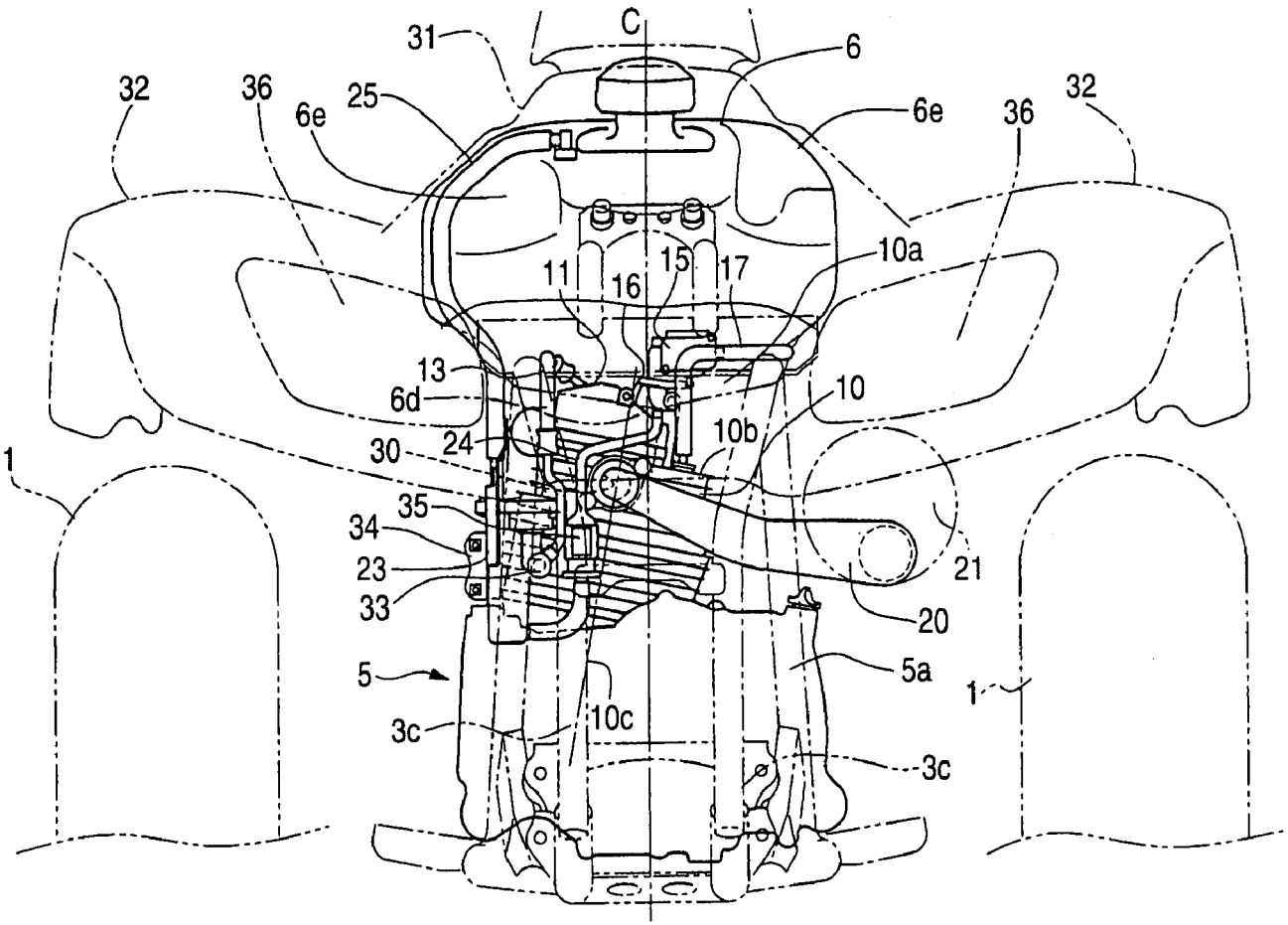
FIG. 5 is a drawing showing the main part from the front of a vehicle body.

FIG. 5 is a drawing showing a front part of the vehicle body. A cylinder axis 10*c* of the cylinder head 10 inclines towards the left side of the vehicle body, whereby the whole of the cylinder head 10 inclines towards the left side of the vehicle body on an upper end side thereof. The cylinder head cover 11 is disposed to be offset to the right side of the vehicle body at the upper portion of the cylinder head 10, and the cylinder head cover 11 and the secondary air supply system 15 overlap a back side of the bottom portion of the fuel tank 6 when viewed from the front of the 4-wheel buggy so shown.

The exhaust port 30 is disposed to be slightly offset towards the right side of the vehicle body from the center C thereof, and the exhaust pipe 20 extends from this exhaust port 30 obliquely downwards towards the left side of the vehicle body and then extends substantially horizontally to the rear along the side of the cylinder head 10. The fuel pump 23 is provided on the right side of the vehicle body which constitutes an opposite side to the side to which the cylinder head 10 is inclined and where the intermediate portion of the exhaust pipe 20 is provided, is disposed outside and substantially in parallel with a front portion 3*c* of the vehicle body frame 3 when viewed from the front of the 4-wheel buggy so shown and is attached to a bracket 34 extending downwards from the upper frame 3*a*.

The return tube 25 extends upwards substantially perpendicularly from the fuel pump 23, is bent once to the right side of the vehicle body in the vicinity of the bottom portion of the fuel tank 6, passes through a recess formed on the side of the fuel tank 6 and is then laid out upwards while being bent relatively small, so that an upper end portion of the return tube 25 overlaps the upper portion of the fuel tank 6.

Reference numeral 31 denotes a front cover which covers a portion over the front portion of the vehicle body which includes the fuel tank 6 and reference numeral 32 denotes a front fender that is integrated with the front cover 31.

Figure 6:
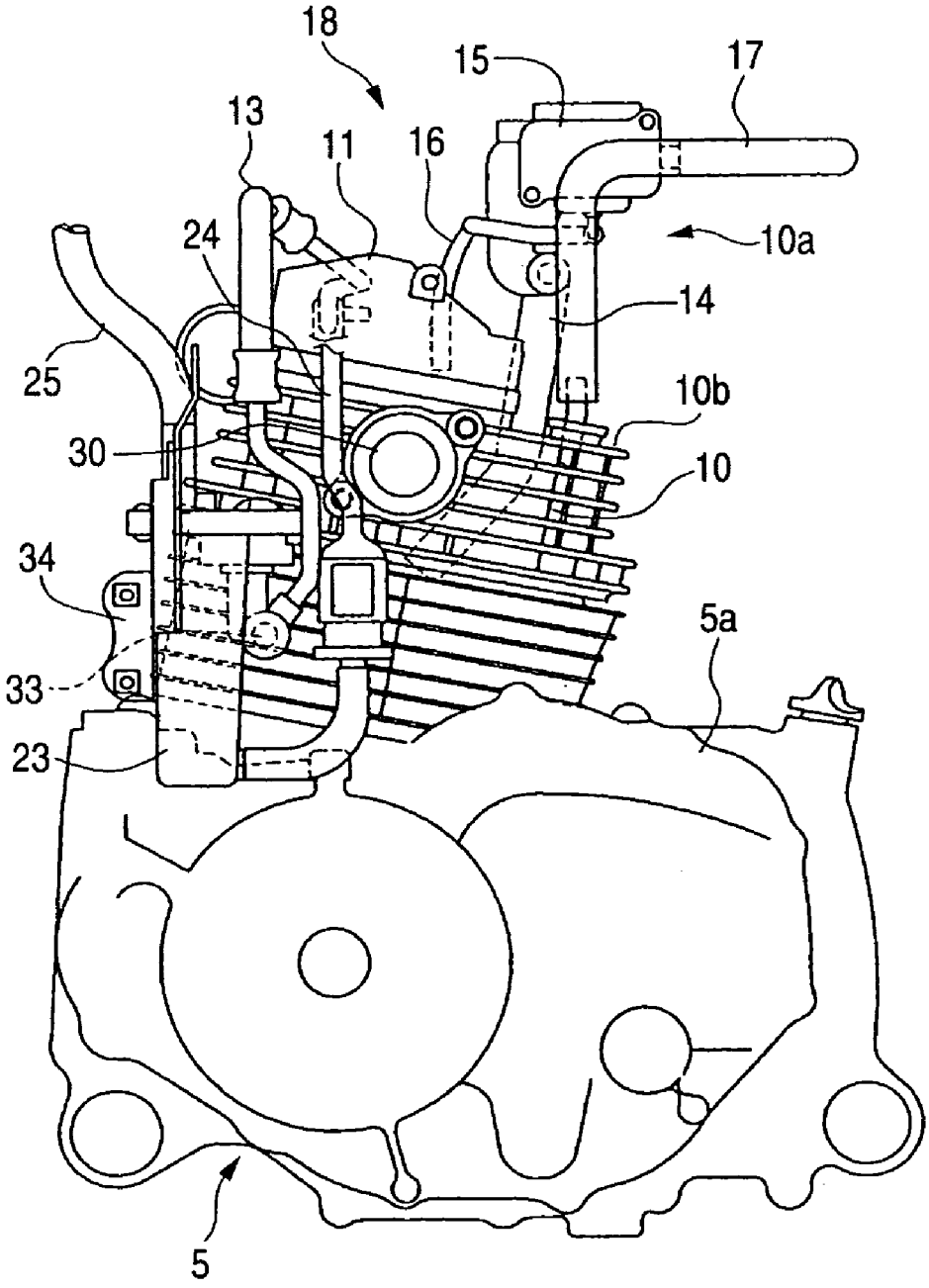
FIG. 6 is a drawing showing the disposition of an engine and a secondary air supply system.

FIG. 6 is a drawing which shows the disposition of the secondary fuel supply system 15 and the furl pump relative to the engine 5 from the front of the vehicle body. A step or difference in level is formed on a left side of the cylinder head cover 11 to form a space 10*a* above a stepped portion where an upper surface of the cylinder head 10 is exposed. This space 10*a* above the stepped portion is part of the above-cylinder space 18, and the secondary air supply system 15 is disposed within this space.

The secondary air suction hose 14 extends downwards from an internal surface of the secondary air supply system 15 within the space 10*a* above the stepped portion.

The vacuum pipe 16 extends substantially horizontally from a bottom portion of the secondary air supply system 15 towards the center of the vehicle body, then bents downwards substantially at the center of the vehicle body so as to overlap a back side of the cylinder head cover 11 and connects to the induction passage situated on an opposite side to the exhaust port 30.

The secondary air delivery pipe 17 protrudes sideways substantially horizontally from an external surface of the secondary air supply system 15, then bends downwards substantially in a U-shape so as to return to a position where it overlaps the secondary air supply system 15 when viewed from the front and bends downwards further from here so as to extend downwards. A lower end portion of the secondary air delivery pipe 17 enters the inside of the cylinder head 10 from a portion 10*b* of the cylinder head 10 where the upper surface thereof is exposed and connects to the vicinity of the exhaust port 30.

The fuel pump 23 is positioned in front of a right-hand portion of the front side of the cylinder head 10, and the fuel feed tube 13, which is connected to a discharge side joint 33 of the fuel pump 23, extends upwards in front of the front side of the cylinder head 10, bends to extend rearwards above the cylinder head cover 11 and bends downwards on the back side of the cylinder head cover 11 so as to connect to the throttle body 12. Reference numeral 34 denotes the support bracket of the fuel pump 23.

Figure 7:
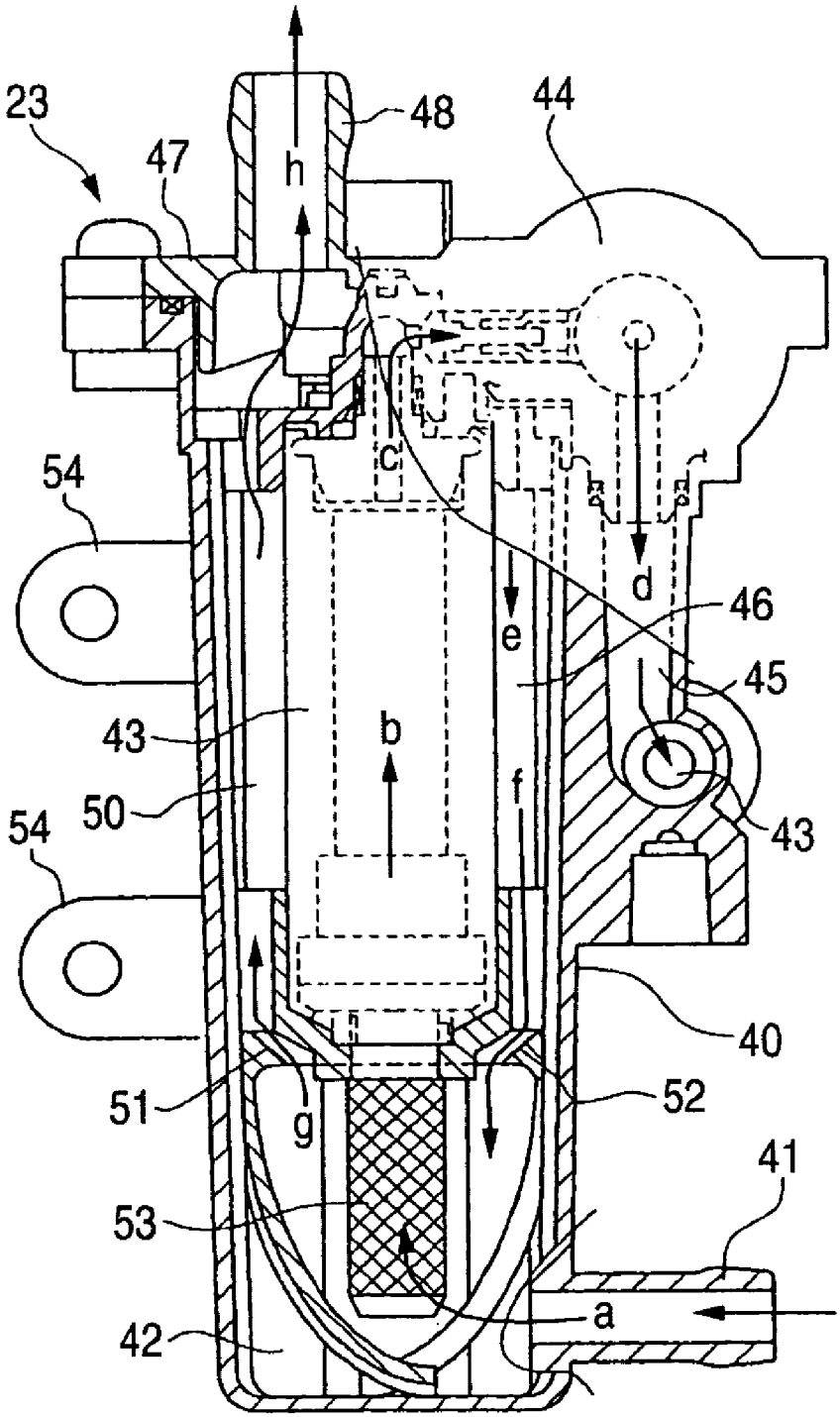
FIG. 7 is a sectional view of a fuel pump.

FIG. 7 illustrates the construction of the fuel pump 23. Reference numeral 40 denotes a case, and a suction side joint 41 is made to protrude from a lower portion of the case 40, so that a lower end of the fuel tube 24 is connected thereto. An inside of the lower portion of the case 40 with which the suction side joint communicates constitutes an auxiliary tank 42, where fuel, which is supplied from the fuel tank 6 via the fuel tube 24 through free fall, is stored.

Fuel within the auxiliary tank 42 is sucked into the interior of a pump unit 43 as indicated by an arrow a for pressurization and is then sent to an upper portion of the case 40 as indicated by an arrow b. The fuel so sent to the upper portion of the case 40 changes its direction as indicated by an arrow c to substantially a horizontal one so as to be sent to a regulator 44 provided aside of the upper portion of the case 40. The pump unit 43 is a known on in which fuel is sent to a passage provided in an axial direction in the interior thereof under pressure by rotation.

The regulator 44 allows the passage of only fuel that is pressurized to a set pressure and causes fuel so allowed to pass therethrough to flow downwards as indicated by an arrow d within a discharge path 45 so as to be sent to the discharge side joint 33. On the other hand, surplus fuel whose pressure exceeds the set pressure is caused to flow downwards as indicated by an arrow e within a fuel return passage 46 so as to be returned to the auxiliary tank 42.

A return joint 48, which protrudes upwards, is provided integrally on an upper surface 47 of the regulator 44 and is connected to a lower end of the return tube 25. The return joint 48 communicates with a vapor passage 50 provided inside the case 40. The vapor passage 50 is formed outside the pump unit 43 in such a manner as to extend vertically, and a lower end thereof is made to communicate with the auxiliary tank 42 via a return hole 51. Vapor resulting from vaporization of fuel inside the auxiliary tank 42 passes through the return hole 51 and the vapor passage 50 to enter the return tube 25 from the return joint 48 and then returns to an upper space in the fuel tank 6. In the figure, reference numeral 52 denotes a fuel return hole which establishes a communication between the auxiliary tank 42 and the fuel return passage 46, reference numeral 53 a suction filter and reference numeral 54 an attachment portion to the support bracket 34.

Figure 8:
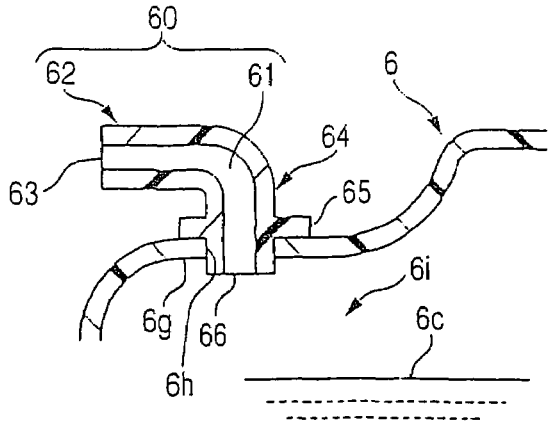
FIG. 8 is a drawing showing a joint construction of a return tube.

FIG. 8 illustrates a connecting construction of the return tube 25 to the fuel tank 6. An upper end of the return tube 25 is made to communicate and connect with the interior of the fuel tank 6 via an L-shaped joint 60 on a stepped portion 6*g* formed on the upper portion of the fuel tank. The L-shaped joint 60 has an L-shaped passage port 61, and an upper portion 62 of the passage port 61 protrudes outwards substantially horizontally, so that a distal end of the return tube 25 is connected to a distal end 63 of the L-shaped passage port 61.

In addition, a flange 65 is integrally formed around a lower portion of the L-shaped joint 60, and the return tube 25 is connected integrally to the fuel tank 6 by superposing this flange portion 65 on the stepped portion 6*g* and integrally connecting the flange portion 65 so superposed to the fuel tank 6 through bonding or thermal welding. A lower end of the lower portion 64 constitutes a protruding portion 66 which protrudes further downwards than the flange portion 65, and this protruding portion 66 is made to protrude into the interior of the fuel tank 6 from a communication hole 6*h* formed in the stepped portion 6*g*. A position where the protruding portion 66 is opened is situated within the upper space 6*i* in the fuel tank 6 which is above the fuel level 6*c* resulting when the fuel tank 6 is filled up, and vapor is returned from here to the interior of the fuel tank 6 so as to be integrated with fuel vapor residing within the upper space 6*i*.

By adopting the construction like this, the connection of the return tube 25 is facilitated, the assembling properties being thereby increased. Moreover, by adoption of the L-shaped joint 60, the joint portion can be made compact. In addition, in this embodiment, even in the event that the fuel tank 6 is such as to be molded from synthetic resin by, for example, blow molding, since the L-shaped joint 60 is connected to the fuel tank 6 at the stepped portion 6*b* which is situated above the fuel level 6*c* resulting when the fuel tank is filled up, the seal construction can be made simpler than the conventional example in which the fuel return pipe is made to pass into the interior of the fuel tank through the bottom surface thereof and the portion where the tube is made to pass through is sealed off by welding.

Moreover, since the protruding portion 66, which constitutes the distal end inserting portion of the L-shaped joint 60, only has to be made to protrude a short distance into the fuel tank 60, a relative long fuel return pipe, which extends from the bottom portion of the fuel tank 6 to above the fuel level 6*c* resulting when the fuel tank is filled up, does not have to be built in as occurring in the conventional example, whereby only a simple consideration of the vibration of the vehicle body has to be taken.

In addition, since only vapor is returned to the space 6*i* above the fuel level 6*c* resulting when the fuel tank is filled up, there is no chance of vapor returning to the interior of the fuel tank while being mixed with return fuel. Consequently, vapor that has been returned to the fuel tank is prevented from being mixed into fuel.

Figure 9:
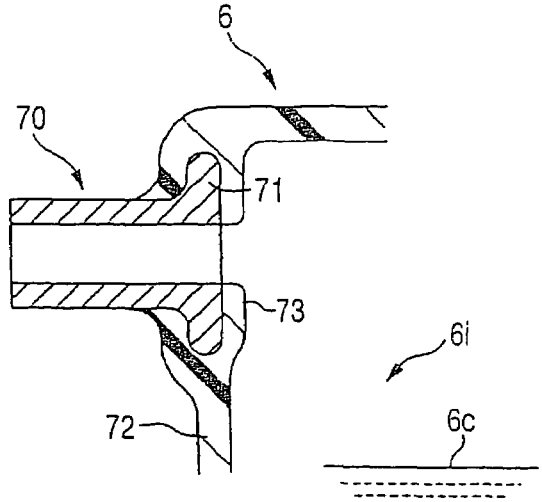
FIG. 9 is a drawing showing another embodiment of a joint construction of the return tube.

FIG. 9 shows a joint construction according to another embodiment in which one end portion 71 of a joint pipe 70 is diametrically expanded into a flange shape, and this diametrically expanded end portion 71 is integrated into a thick portion 72 on a side of a fuel tank 6 through insert molding when the fuel tank 6 is molded. In this embodiment, since part of the thick portion 72 on the wall surface of the fuel tank 6 constitutes a covering portion 72 which covers the circumference of the diametrically expanded end portion 71 so as to be integrated with the joint pipe 70, the joint construction can be made simpler and a resulting seal construction can ensure a proper seal without requiring any special process.

Note that in a case where the fuel tank 6 is molded from synthetic resin, the joint pipe can be molded continuously and integrally with a main body portion of the fuel tank, and by adopting this construction, since there is no need to join a separate joint member to the fuel tank or to join and incorporate a separate joint member into the fuel tank through insert molding, the formation of the joint can be simplified further.

Figure 10:
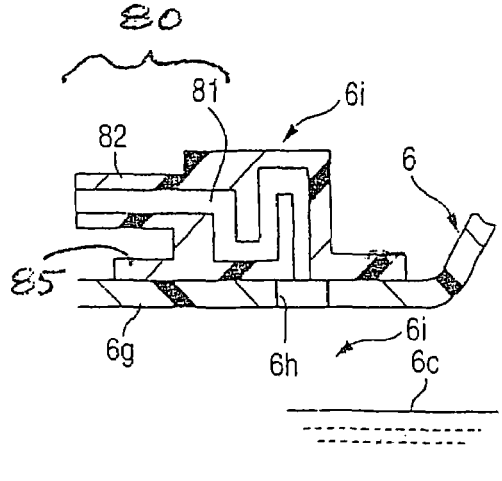
FIG. 10 is a drawing showing a further embodiment of a joint construction of the return tube.

FIG. 10 illustrates a joint construction according to a further embodiment in which a passage 81 having a labyrinth construction is formed in the interior of an L-shaped joint 80. One end of the passage 81 protrudes forward so as to communicate with a pipe portion 82 to which the return tube 25 is connected, and the other end thereof communicates with a communication hole **6*h* provided in the stepped portion 6*g*. By adopting this construction, dust or the like residing within the fuel tank 6 can be prevented from flowing reversely to the side of the return tube 25**.

Note that the L-shaped joint 80 is formed from a resin or the like. As this occurs, in the event that the L-shaped joint 80 is made from a thermoplastic resin, a flange 85 that is provided integrally therewith is superposed on the stepped portion **6*g* so as to be integrated therewith through heat seal. In addition, in the event that the L-shaped joint 80** is made from a material of the same system as that of the fuel tank, a connection by an adhesive is facilitated.

Next, the function of the embodiments will be described. As shown in FIG. 1 and the like, since the fuel pump 23, which is disposed separately from the fuel tank 6, is integrated with the auxiliary tank 42, surplus fuel does not have to be returned to the fuel tank 6 by a fuel return pipe, and therefore, such a fuel return pipe can be omitted. In addition, only vapor can be returned to the space **6*i* above the fuel level 6*c* resulting when the fuel tank 6 is filled up by the vapor return tube 25, which is the exclusive vapor return unit, so that the mixture of vapor into fuel inside the fuel tank 6** can be prevented.

Moreover, since the fuel pump 23 is disposed below the fuel tank 6, the piping of the vapor return tube 25, which constitutes the vapor return unit as well as the fuel supply means, can be made short, and the laying out of the piping can be facilitated. Moreover, since vapor rises smoothly through the vapor return tube 25 most of which is disposed substantially perpendicularly in the vertical direction, the return thereof can be ensured.

In addition, as shown in FIG. 2, since the fuel pump 23 is disposed on the opposite side to the side where the exhaust pipe 20 is provided, the fuel pump 23 can be disposed away from the exhaust pipe 20, whereby the thermal effect from the exhaust pipe 20 can be reduced, thereby making it possible to suppress the generation of vapor.

Furthermore, since the fuel pump 23 is disposed back of the cooling fan 26, the fuel pump 23 can be cooled by the cooling fan 26, whereby the fuel pump 23 is made difficult to be subjected to the thermal effect from the engine 5. Due to this, the generation of vapor can be suppressed further.

Additionally, since the upper portion of the vapor return tube 25 which is part of the vapor return unit is laid out in such a manner as to extend along the external surface of the fuel tank 6 and to pass through the recess **6*f* provided on the surface of the fuel tank 6 so that the vapor return tube 25 communicates and connects with the interior of the fuel tank 6 at the position above the fuel level 6*c* resulting when the fuel tank 6 is filled up, the vapor return tube 25 does not have to be laid out in such a manner as to pass through the bottom surface of the fuel tank 6** into the interior thereof as has been seen in the conventional example, and the sealing of the connecting portion can be facilitated and the assembling and building of the constituent components can be facilitated.

Note that the present invention is not limited to the embodiments that have been described heretofore but may be modified variously so as to be applied in various ways. For example, the present invention can be applied to any other types of saddle-riding type vehicles including two-wheeled motor cycles. In addition, a water-cooled engine may be adopted, and in this case, the cooling fan 26 is made to be used to cool a radiator.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A vehicle having a fuel supply construction, comprising:

a fuel tank storing fuel;

a fuel pump supplying the fuel in the fuel tank to a fuel injection system for injection into an engine; and a vapor return unit for returning vapor of vaporized fuel generated in the fuel pump to the fuel tank, wherein the fuel pump is disposed separately from the fuel tank, is integrated with an auxiliary fuel tank, the auxiliary fuel tank including the vapor return unit, wherein the vapor return unit is adapted to be used exclusively with the auxiliary fuel tank for returning only vapor generated in an interior auxiliary fuel tank to the fuel tank, wherein the fuel tank is disposed at a higher position relative to an auxiliary fuel tank, and wherein the fuel pump is disposed in back of an engine cooling fan, which is disposed in front of an engine, so that the fuel pump is cooled by the engine cooling fan.

2. The vehicle having a fuel supply construction as set forth in claim 1, wherein an exhaust pipe is provided in such a manner as to be laid on one side of a vehicle body, while the fuel pump is disposed on an opposite side of the vehicle body.

3. The vehicle having a fuel supply construction as set forth in claim 1, wherein the fuel pump is disposed back of an engine cooling fan which is disposed in front of the engine.

4. The vehicle having a fuel supply construction as set forth in claim 1, wherein the fuel pump is disposed below the fuel tank.

5. The vehicle having a fuel supply construction as set forth in claim 1, wherein part of piping of the vapor return unit is laid along an external surface of the fuel tank so as to communicate and connect with an interior of the fuel tank at a higher position than a fuel level resulting when the fuel tank is filled up.

6. The vehicle fuel having a fuel supply construction as set forth in claim 1, wherein the vapor return unit extends substantially vertical direction from an upper portion of the fuel pump to an upper portion of the fuel tank.

7. A vehicle fuel supply construction, comprising:

a fuel tank storing fuel;

a fuel pump supplying fuel in the fuel tank to a fuel injection system for injection into an engine; and a vapor return unit for returning vapor of vaporized fuel generated in the fuel pump to the fuel tank, wherein the fuel pump is disposed separately from the fuel tank, and is integrated with an auxiliary fuel tank, wherein the vapor return unit is exclusively used by the fuel pump for returning only vapor generated in an interior thereof to the fuel tank, and wherein the fuel pump includes a return joint protruding upwardly on an upper surface thereof, the return joint connecting an end of the vapor return unit.

8. The vehicle having a fuel supply construction as set forth in claim 1, the vehicle fuel supply construction further comprising:

a L-shaped joint which connects the vapor return unit with the fuel tank on an upper portion of the fuel tank, the L-shaped joint having:

a flange portion on which the L-shaped joint is fixed to the fuel tank; and a protrusion portion protruded from the flange portion to the interior of the fuel tank.

9. The vehicle having a fuel supply construction as set forth in claim 8, wherein a passage formed within the L-shaped joint is labyrinth construction.

10. The vehicle having a fuel supply construction as set forth in claim 1, the vehicle fuel supply further comprising a joint including:

a cylinder portion; and a large-diameter portion on one end thereof, on which the joint fixes to the fuel tank, wherein a side wall of the fuel tank has a covering portion which covers circumference of the large-diameter portion of the joint.

11. A vehicle fuel supply construction, comprising:

a fuel tank storing fuel;

a fuel pump supplying fuel in the fuel tank to a fuel injection system for injection into an engine; and a vapor return unit for returning vapor of vaporized fuel generated in the fuel pump to the fuel tank, wherein the fuel pump is disposed separately from the fuel tank, and is integrated with an auxiliary fuel tank, wherein the vapor return unit is exclusively used by the fuel pump for returning only vapor generated in an interior of the fuel pump to the fuel tank, the vehicle fuel supply construction further comprising:

a L-shaped joint which connects the vapor return unit with the fuel tank on an upper portion of the fuel tank, the L-shaped joint having:

a flange portion on which the L-shaped joint is fixed to the fuel tank; and a protrusion portion protruded from the flange portion to the interior of the fuel tank.

12. The vehicle fuel supply construction as set forth in claim 11, wherein the fuel pump includes a return joint protruding upwardly on an upper surface thereof, the return joint connecting an end of the vapor return unit.

13. The vehicle fuel supply construction as set forth in claim 11, wherein a passage formed within the L-shaped joint is labyrinth construction.

14. The vehicle fuel supply construction as set forth in claim 11, the vehicle fuel supply construction further comprising a joint including:

a cylinder portion; and a large-diameter portion on one end thereof, on which the joint fixes to the fuel tank, wherein a side wall of the fuel tank has a covering portion which covers circumference of the large-diameter portion of the joint.

15. The vehicle fuel supply construction as set forth in claim 7, the vehicle fuel supply construction further comprising a joint including:

a cylinder portion; and a large-diameter portion on one end thereof, on which the joint fixes to the fuel tank, wherein a side wall of the fuel tank has a covering portion which covers circumference of the large-diameter portion of the joint.

16. The vehicle fuel supply construction as set forth in claim 7, wherein a passage formed within the L-shaped joint is labyrinth construction.

17. The vehicle fuel supply construction as set forth in claim 1, the vehicle fuel supply construction further comprising:

a joint which connects the vapor return unit with the fuel tank on an upper portion of the fuel tank, the joint having one end that is diametrically expanded into a flange shape that is fitted into a thick portion of the fuel tank.

18. The vehicle fuel supply construction as set forth in claim 7, the vehicle fuel supply construction further comprising:

a joint which connects the vapor return unit with the fuel tank on an upper portion of the fuel tank, the joint having one end that is diametrically expanded into a flange shape that is fitted into a thick portion of the fuel tank.

19. The vehicle fuel supply construction as set forth in claim 1, wherein part of piping of the vapor return unit is laid in a groove on a side surface of the fuel tank so as to communicate and connect with an interior of the fuel tank.

20. The vehicle fuel supply construction as set forth in claim 7, wherein part of piping of the vapor return unit is laid in a groove on a side surface of the fuel tank so as to communicate and connect with an interior of the fuel tank.

21. The vehicle fuel supply construction as set forth in claim 11, wherein part of piping of the vapor return unit is laid in a groove on a side surface of the fuel tank so as to communicate and connect with an interior of the fuel tank.

* * * * *